US011071438B2

(12) United States Patent
Budzynski et al.

(10) Patent No.: US 11,071,438 B2
(45) Date of Patent: Jul. 27, 2021

(54) DISHWASHER, IN PARTICULAR DOMESTIC DISHWASHER

(71) Applicant: BSH Hausgeräte GmbH, Munich (DE)

(72) Inventors: Andrzej Budzynski, Augsburg (DE); Dieter Hotz, Dischingen (DE); Armin Klaiber, Günzburg (DE); Cengiz Kücük, Syrgenstein (DE); Johann Schabert, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 410 days.

(21) Appl. No.: 15/751,483

(22) PCT Filed: Aug. 24, 2016

(86) PCT No.: PCT/EP2016/069924
§ 371 (c)(1),
(2) Date: Feb. 9, 2018

(87) PCT Pub. No.: WO2017/032779
PCT Pub. Date: Mar. 2, 2017

(65) Prior Publication Data

US 2020/0196829 A1 Jun. 25, 2020

(30) Foreign Application Priority Data

Aug. 25, 2015 (DE) ..... 102015216228.1

(51) Int. Cl.
*A47L 15/42* (2006.01)

(52) U.S. Cl.
CPC ..... *A47L 15/4246* (2013.01)

(58) Field of Classification Search
CPC ..... A47L 15/4204; A47L 15/4246; A47L 15/00–508
See application file for complete search history.

(56) References Cited

U.S. PATENT DOCUMENTS

2005/0285487 A1 12/2005 Noh
2006/0219272 A1* 10/2006 Lee ..... A47L 15/4225 134/56 D (Continued)

FOREIGN PATENT DOCUMENTS

CN 104939783 A 9/2015
DE 7516419 U 3/1976

(Continued)

OTHER PUBLICATIONS

DE102011088129A1 Machine Translation (Year: 2013).*

(Continued)

*Primary Examiner* — Spencer E Bell
(74) *Attorney, Agent, or Firm* — Michael E. Tschupp; Andre Pallapies; Brandon G. Braun

(57) ABSTRACT

A dishwasher includes a dishwashing compartment having a front side with a charging opening for allowing the dishwashing compartment to be charged with washware. The dishwashing compartment includes a U-shaped metal shroud to define a right-hand side wall, a ceiling and a left-hand side wall, a hollowed metal floor produced from a deep-drawn part, and a metal rear wall fitted to a rear side of the metal shroud and of the hollowed metal floor. The right-hand and left-hand side walls of the metal shroud are connected along their respectively lower wall edges to the hollowed metal floor via external interfaces, with each of the external interfaces having a form-fitting connection. A compartment door is provided to close the charging opening, at least temporarily.

14 Claims, 9 Drawing Sheets

(56) References Cited

U.S. PATENT DOCUMENTS

| | | | | |
|---|---|---|---|---|
| 2009/0095335 | A1 | 4/2009 | Buehlmeyer et al. | |
| 2010/0192990 | A1* | 8/2010 | Hotz | A47L 15/4246 134/115 R |
| 2011/0155187 | A1* | 6/2011 | Oppel | A47L 15/4246 134/117 |
| 2014/0305474 | A1* | 10/2014 | Tempelmann | A47L 15/4204 134/110 |
| 2016/0029869 | A1* | 2/2016 | McKinney | A47L 15/48 134/21 |
| 2016/0208469 | A1* | 7/2016 | Dover | E03C 1/182 |

FOREIGN PATENT DOCUMENTS

| | | | | |
|---|---|---|---|---|
| DE | 7520122 | U | 4/1976 | |
| DE | 10048508 | A1 | 4/2002 | |
| DE | 102009001896 | A1 | 9/2010 | |
| DE | 102009001897 | A1 | 9/2010 | |
| DE | 102010029763 | A1 | 12/2011 | |
| DE | 102011004056 | A1 | 8/2012 | |
| DE | 102011004222 | A1 | 8/2012 | |
| DE | 102011017635 | A1 | 10/2012 | |
| DE | 102011088129 | A1 | 6/2013 | |
| GB | 1227699 | | 4/1971 | |
| GB | 2064309 | A | 6/1981 | |
| WO | WO-2010133514 | A1 * | 11/2010 | A47L 15/4263 |

OTHER PUBLICATIONS

DE102011017635A1 Machine Translation (Year: 2012).*
International Search Report PCT/EP2016/069924 dated Nov. 28, 2016.
National Search Report CN 201680049410 dated Oct. 29, 2019.

* cited by examiner

Fig. 12A
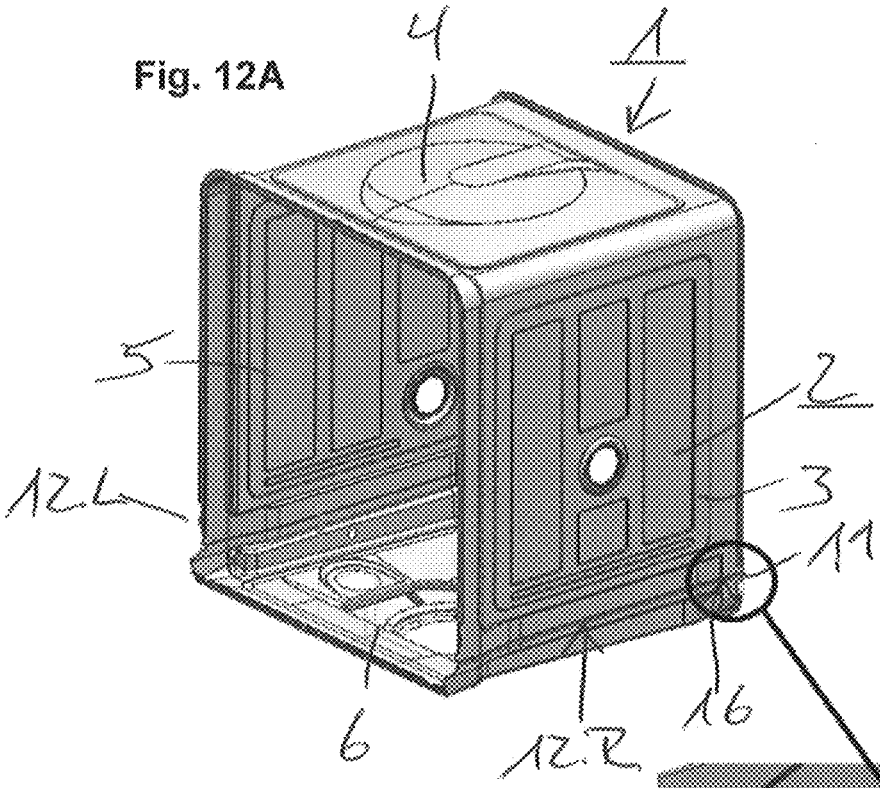
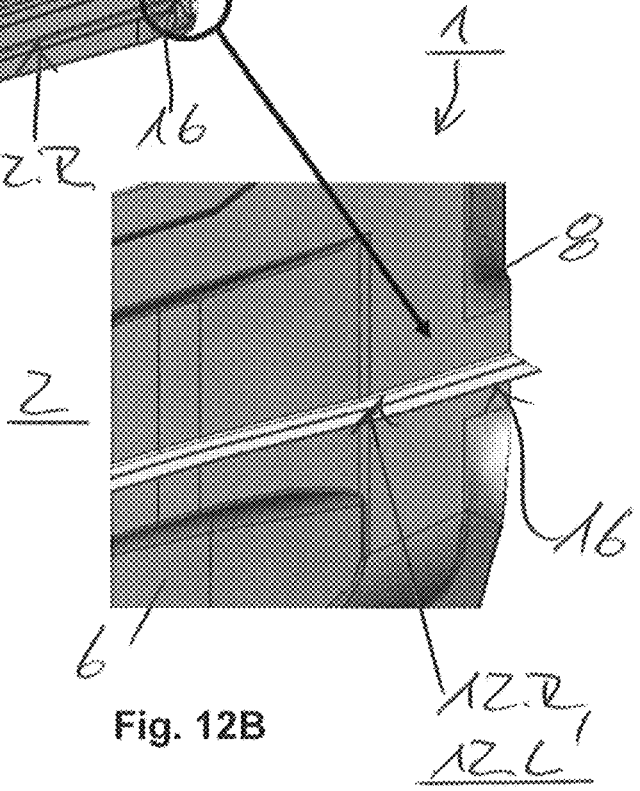
Fig. 12B

DISHWASHER, IN PARTICULAR DOMESTIC DISHWASHER

CROSS-REFERENCES TO RELATED APPLICATIONS

This application is the U.S. National Stage of International Application No. PCT/EP2016/069924 filed Aug. 24, 2016, which designated the United States and has been published as International Publication No. WO 2017/032779 A1 and which claims the priority of German Patent Application, Serial No. 10 2015 216 228.1, filed Aug. 25, 2015, pursuant to 35 U.S.C. 119(a)-(d).

BACKGROUND OF THE INVENTION

The invention relates to a dishwasher, in particular a domestic dishwasher, having a dishwashing compartment which comprises a plurality of wall parts and which, in order to be charged with washware, is provided on the front side with a charging opening which can be closed, at least temporarily, by a compartment door.

Such a dishwasher is disclosed, for example, in the publication DE 75 20 122 U1. The disclosed dishwasher comprises a dishwashing compartment having a casing which is open on the front side for charging with washware, which is made of a plurality of sheet metal blanks which are connected together by folding and assembled in a sealed manner, and which has an offset edge at least partially surrounding the charging opening for receiving a seal. The edge is shaped in a stepped manner by expanding the edge zone of the folded dishwashing compartment surrounding the charging opening. The expanded edge may extend over the side walls and the ceiling of the dishwashing compartment, while the floor may have an expanded undercut on the charging opening. In the embodiment shown, the first sheet metal blank is the ceiling of the dishwashing compartment, while the second sheet metal blank forms the central portion of the dishwashing compartment, with the side walls and the rear wall thereof. The second sheet metal blank thus forms the vertical walls of the dishwashing compartment and, therefore, in the installed state it represents the shape of a so-called "horizontal U-shape". In addition, the third sheet metal blank finally forms the floor of the dishwashing compartment.

The publication DE 69 24 403 U1 discloses a dishwashing compartment for a dishwasher having floor, ceiling and side walls made of sheet metal and connected together. The respective side wall is connected to the floor and ceiling walls by crimping the adjacent edges. Thus in the installed state, the vertical side walls which are made out of one piece of sheet metal in turn represent the shape of a so-called "horizontal U-shape".

The publication GB 2 064 309 B also discloses a dishwashing compartment for a dishwasher, having floor, ceiling and side walls which are made of sheet metal and connected together. The respective side wall is connected to the floor and ceiling walls by crimping the adjacent edges. Thus in the installed state, the three vertical side walls which are made out of one piece of sheet metal also represent the shape of a so-called "horizontal U-shape".

The design of the vertical side walls of the dishwashing compartment in the installed state in the form of a so-called "horizontal U-shape" has the serious drawback in terms of production technology in that no rear wall flange is present for receiving any forces acting on the dishwashing compartment, for example during transport or when storing the dishwasher. Thus a second frame part generally has to be attached as a fastening element and a force transmission element in the rear region of the dishwasher. This second frame part results in additional production and assembly costs.

The publication DE 75 16 419 U1 discloses a compartment, in particular for dishwashers which are able to be charged on the front side, having a compartment portion which is preferably shaped by expanding an annular sheet metal casing, comprises a hollowed floor, side walls and ceiling, and which is closed by a wall fitted to its rear side. The compartment portion is made up of two sheet metal blanks of different widths, the wider sheet metal blank forming the floor and the narrower sheet metal blank forming the side walls and the ceiling.

Over the years, it has been shown that the construction of an expander for producing an at least partially expanded dishwashing compartment is very intensive in terms of development and thus involves above-average cost. Moreover, during operation, such an expander is exceptionally maintenance-intensive and thus cost-intensive and particularly susceptible to unforeseen stoppage times.

The publication DE 10 2010 029 763 A1 discloses a device for a dishwashing compartment of a dishwasher, in particular a domestic dishwasher, which is provided for receiving washware during a washing cycle and on a lower side comprises a washing tub, in particular made of plastic. The device comprises a sheet metal part for at least partially cladding an upper side of the washing tub.

The publication EP 1 609 403 B1 discloses a dishwashing compartment of a dishwasher, comprising an upper plate, a lower plate attached below the upper plate and a central plate which is connected vertically between the upper plate and the lower plate. The upper plate, the central plate and the lower plate have corner welded portions, the internal bending radii thereof being configured to be smaller than the external bending radii of the corner welded portions.

BRIEF SUMMARY OF THE INVENTION

In view of this background to the invention, an object of the present invention is to provide a dishwasher, in particular a domestic dishwasher, having a noticeably improved dishwashing compartment.

To achieve the object according to the invention, a dishwasher is proposed, in particular a domestic dishwasher, having a dishwashing compartment which comprises a plurality of wall parts and, in order to be charged with washware, being provided on the front side with a charging opening which can be closed, at least temporarily, by a compartment door. In this case, the right-hand metal side wall, the metal ceiling and the left-hand metal side wall form a metal shroud of the dishwashing compartment, which in the straightened-out state formed a preferably flat press part and was then bent in a U-shaped manner. Moreover, a hollowed metal floor is a deep-drawn part produced from a preferably austenitic steel, and the metal rear wall which is fitted to the rear side of the metal shroud and of the hollowed metal floor is designed in the form of a preferably flat press part. The two side walls of the metal shroud are further connected along their respectively lower wall edge, preferably in a form-fitting manner, to the hollowed metal floor by means of external interfaces. In addition, the external interface comprises a form-fitting connection, in particular a dynamic or static fold.

The dishwasher according to the invention, in particular a domestic dishwasher having such a dishwashing compartment, the two metal side walls thereof, together with the metal ceiling connecting the side walls together, being arranged as a metal shroud in the form of a so-called "vertical U-shape", is characterized by simpler, more flexible and more cost-effective manufacturing facilities due to the potential use of pressing and tool technology. This results in a considerable cost advantage in terms of investment, in direct comparison with conventional expansion technology. In addition, the production of the manufacturing facilities is simpler and thus more cost-effective. With regard to the manufacturing quality, an improved tolerance compensation of the wall parts is possible, in comparison with a "horizontal U-shape" as the known basic shape of the dishwashing compartment.

Since only the hollowed metal floor is a deep-drawn part, this results in lower material costs, in direct comparison with a "horizontal U-shape" as the known basic shape of the dishwashing compartment. In a "horizontal U-shape", the metal ceiling is also a deep-drawn part which ultimately means more wastage of the sheet metal.

Moreover, the rear wall flange, which is known from expansion technology and universally established, is maintained. This results in greater possibilities for integration within existing design ranges, established add-on components of the dishwasher, such as for example a heat exchanger, side walls or the like, being able to be transferred substantially identically and comprehensively from previous constructions.

Moreover, a ferritic steel according to WNr. 1.4016 which is cost-effective and able to be easily processed, may be used for the metal shroud and the metal rear wall of the dishwashing compartment.

Due to the use of a metal rear wall, which is preferably designed as a flat press part, a second frame part as the fastening element and force transmission element in the rear region of the dishwasher may be entirely dispensed with and thus material costs saved.

The hollowed metal floor may also be produced from a ferritic steel. In this case, however, the sealing bed between the shroud and the hollowed floor has to be optimized with regard to corrosion, for example by the use of a plastic frame between the hollowed floor made of a ferritic steel, on the one hand, and the metal shroud and the metal rear wall, on the other hand. Such a plastic frame is disclosed, for example, in the publication WO 2009/003823 A2; the relevant disclosure of this publication thus forms the subject-matter of the present disclosure.

Instead of the hollowed metal floor which is a deep-drawn part produced from a preferably austenitic steel, a plastic floor may also be used as an alternative. Thus the two alternatives of a dishwashing compartment with a hollowed metal floor or a dishwashing compartment with a hollowed plastic floor are provided. In the second-mentioned alternative, only minor adaptations are required in the region of the metal rear wall. Should the dishwashing compartment have a hollowed plastic floor, this may be clad at least partially on its upper side adjacent to the washing tub of the dishwashing compartment with at least one sheet metal part, preferably made of a corrosion-resistant metal, in particular stainless steel. Such a cladding of a hollowed plastic floor of a dishwashing compartment of a dishwasher is disclosed, for example, in the publication DE 10 2010 029 763 A1; the relevant disclosure of this publication thus forms the subject-matter of the present disclosure.

The dishwasher according to the invention having the disclosed dishwashing compartment design, therefore, provides the possibility of combining the advantages of expansion technology with a "vertical U-shape", "horizontal U-shape" shroud technology and "vertical U-shape" shroud technology, in a positive and advantageous manner.

In specialized circles, moreover, the term "case" is used. Within the scope of this disclosure, the term "case" is understood as a sub-assembly formed at least from the shroud and the hollowed floor.

The external connection of the two side walls of the metal shroud to the hollowed metal floor provides the advantage of a connection which is remote from the dishwashing compartment and which is subjected only to a small amount of rinsing liquor, and preferably no rinsing liquor. However, a form-fitting connection is advantageous with regard to the tightness and effective service life of the fluid-tight connection.

The form-fitting connection, in particular the dynamic or static fold, on the external interface is characterized by a high degree of tightness and stability over time.

Folding is a technique in sheet metal processing in which a sheet metal edge is bent back in order to produce stiffening of the edge. As a combined method, crimping may also be used in order to produce a connection of a plurality of components by shaping. In this case, it is possible to connect both components made of the same materials and components made of different materials, thus for example metal sheets may be connected to plastic. If roller systems are used during the folding process, preferably guided by standard industrial robot systems, then this is referred to as roll folding or dynamic folding. If, however, static tools are used during the folding process, then this is referred to as static folding.

According to a further embodiment, the two external interfaces, the metal shroud and the hollowed metal floor in their regions on the rear side, i.e. the regions remote from the compartment door of the dishwasher, have an outward 90° bend. Such a bend provides the two external interfaces with a high degree of strength and stability with relatively low production costs.

According to a further embodiment, the two external interfaces in their regions on the front side, i.e. the regions facing the compartment door of the dishwasher, at least in sections have a radius of at least 80 mm outwardly, preferably of at least 100 mm outwardly, in particular of at least 80 mm outwardly, and/or in their regions on the rear side, i.e. the regions remote from the compartment door of the dishwasher, a linear path or an approximately linear path. The regions with the cited radii represent so-called fold angles which result in an increase in the clearance of the dishwashing compartment, so that further components and sub-assemblies are afforded installation space in the front region of the dishwashing compartment.

According to a further embodiment, the metal rear wall fitted on the rear side to the metal shroud and to the hollowed metal floor is attached by means of at least one sealing means in a substantially fluid-tight manner in the region of the edge regions in contact with one another, in particular is adhesively bonded thereon and/or preferably spot-welded. Generally, the sealing means may comprise a silicone material or a contact adhesive. Silicone materials, including silicone, is a term for a group of synthetic polymers in which silicon atoms are bonded via oxygen atoms. Such a rear attachment of the metal rear wall to the metal shroud and to the hollowed metal floor is disclosed, for example, in the publication DE 10 2009 001 896 A1 and the publication DE 10 2009 001 897 A1; the relevant disclosure of these two publications thus forms the subject-matter of the present disclosure. Should the metal rear wall be adhesively bonded on, then the sealing means preferably comprises a contact adhesive. A contact adhesive in this case by definition is a permanently adhering adhesive which in the dry state at room temperature adheres after slight pressure to a plurality of surfaces and may be removed again and adhesively bonded once again elsewhere.

According to a further embodiment, the metal shroud is provided on the front side with a U-shaped frame part which is downwardly open and forms a front surface of the dishwashing compartment, which is preferably connected by means of riveting, in particular thermal riveting, to the metal shroud, preferably in a form-fitting manner, which frame part engages in the hollowed metal floor and which frame part receives the door seal in a groove-shaped contour. Such a frame part is disclosed, for example, in the publication WO 2007/048697 A1; the relevant disclosure of this publication thus forms the subject-matter of the present disclosure. The frame part preferably comprises a plastic, in particular a glass fiber-reinforced polypropylene, and is fastened by means of thermal riveting technology at least to the metal shroud of the dishwashing compartment. In addition, the same frame part may be used for a dishwashing compartment with a hollowed metal floor or a dishwashing compartment with a hollowed plastic floor.

According to a further embodiment, the frame part which preferably comprises at least one plastic forms a front surface of the interior of the dishwashing compartment, so that the metal shroud of the dishwashing compartment is partially covered on the inside by the frame part and the dishwashing compartment has a high degree of tightness.

According to a further embodiment, the heights of the two metal side walls, the metal rear wall and the frame part are selected such that the dishwasher has an appliance height in the region of approximately 86.5 cm, approximately 81.5 cm, approximately 77.5 cm, approximately 60 cm or approximately 45 cm. In the case of the cited appliance heights, the dishwasher has no work surface on the upper side. The trend for high-level dishwashers continues to rise, with the average height of humans increasing, a growing sensitivity to postural problems and painful back injuries. Different appliance heights above 80 cm ensure individual options for use in built-in and undermounted applications. A dishwasher having an appliance height of 81.5 cm has a body size, by definition the base cabinet height minus the plinth height, of between 655 and 725 mm and is height-adjustable between 815 and 875 mm. However, a dishwasher having an appliance height of 86.5 cm has a working height of 90/91 cm and a body size of between 705 and 775 mm and is height-adjustable between 865 and 925 mm. A high-level dishwasher has an appliance height of 45.4 cm or 59.5 cm, but as a table-top dishwasher an appliance height of 45 cm. With a dishwasher which is based on the dishwashing compartment design according to the invention, all of these specified appliance heights may be produced cost-effectively and in a highly flexible manner.

According to a further embodiment, the metal shroud forming the right-hand metal side wall, the metal ceiling and the left-hand metal side wall, comprises an austenitic steel according to WNr. 1.4301 or a ferritic steel according to WNr. 1.4016. Both types of steel are able to be obtained cost-effectively and are generally able to be easily processed.

According to a further embodiment, due to the required capacity for shaping and the requirements regarding corrosion, the hollowed metal floor comprises an austenitic steel according to WNr. 1.4301.

According to a further embodiment, the hollowed metal floor on the lower side preferably indirectly carries a pump well, in a substantially fluid-tight manner on an annular collar configured in the hollowed metal floor, by means of at least one sealing means, wherein the annular collar has a ring angle of 1 to 10°, preferably of 2 to 5°, in particular of approximately 3°. The pump well on the upper side is covered by a filter, wherein the filter is at least positionable in a filter collar which is configured in the hollowed metal floor and which has a filter angle of 2 to 10°, preferably of 4 to 8°, in particular of approximately 5°. Due to these angular ranges, a permanent tightness of the system may be ensured without further measures.

The dishwasher may be, in particular, a domestic dishwasher.

Further possible implementations of the invention also comprise not specifically cited combinations of features or embodiments which are described above or below relative to the exemplary embodiments. In this case, the person skilled in the art will also add individual features as improvements or additions to the respective basic form of the invention.

Further advantageous embodiments and features of the invention form the subject-matter of the subclaims and the exemplary embodiments of the invention described hereinafter. The invention is described in more detail hereinafter by means of preferred embodiments with reference to the accompanying figures.

BRIEF DESCRIPTION OF THE DRAWINGS

In the figures:

FIG. 12A shows a further schematic perspective view of a preferred embodiment of the dishwashing compartment of the dishwasher according to the invention of FIG. 1;

FIG. 12B shows a detailed view of the preferred embodiment of the dishwashing compartment of the dishwasher according to the invention of FIG. 12A;

DETAILED DESCRIPTION OF EXEMPLARY EMBODIMENTS OF THE PRESENT INVENTION

Figure 1:
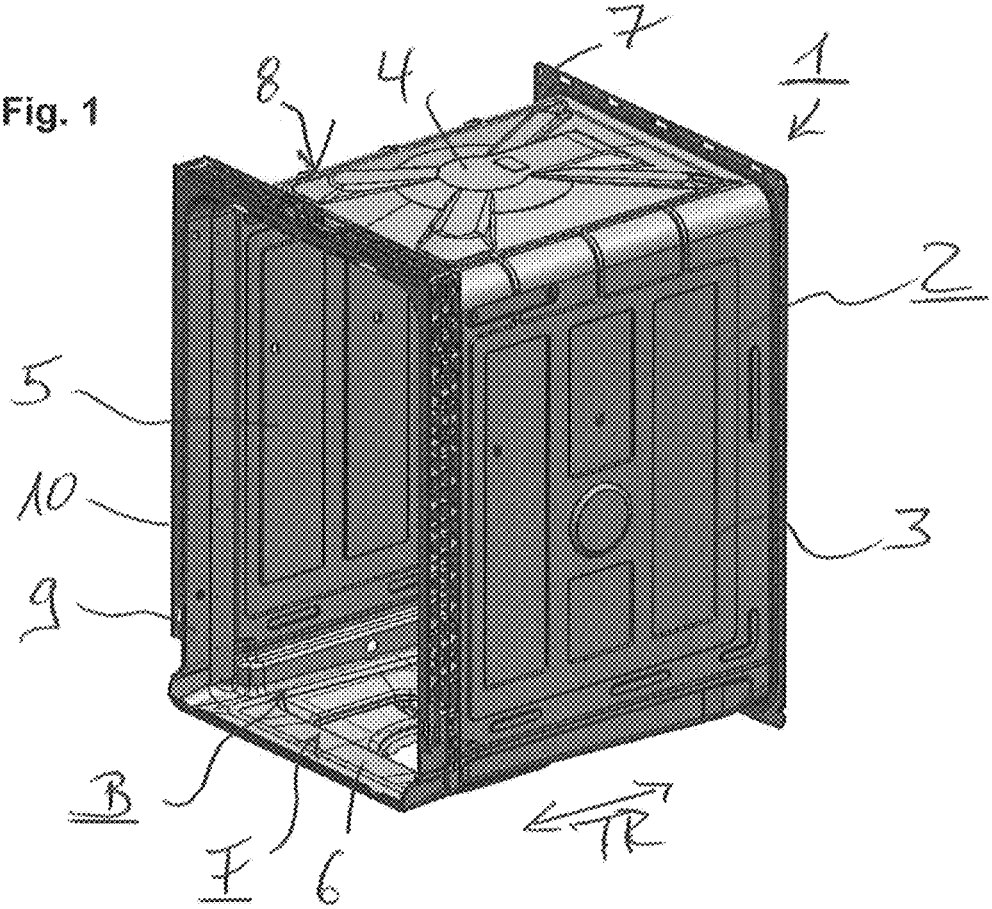
FIG. 1 shows a schematic perspective view of a preferred embodiment of the dishwashing compartment of the dishwasher according to the invention obliquely from the front.

In the figures, elements which are the same or functionally the same have been provided with the same reference numerals, provided nothing further is specified.

FIG. 1 shows a schematic perspective view of a dishwashing compartment 2 of a dishwasher 1, in particular a domestic dishwasher obliquely from the front.

The dishwashing compartment 2 comprises a plurality of wall parts 3 to 7 and, in order to be charged with washware, is provided on the front side with a charging opening B which can be at least temporarily closed by a compartment door, not shown, but known to the person skilled in the art. In this case, the right-hand metal side wall 3, the metal ceiling 4 and the left-hand metal side wall 5 as wall parts form a metal shroud 8 which in the straightened-out state formed a flat press part and was then bent in a U-shaped manner. A hollowed metal floor 6 as a further wall part is a deep-drawn part produced from an austenitic steel according to WNr. 1.4301. A metal rear wall 7 which is fitted to the rear side of the metal shroud 8 and of the metal hollowed floor 6 is designed in the form of a preferably flat press part.

The hollowed metal floor 6, however, may also be produced from a ferritic steel. In this case, however, the sealing bed between the shroud and the hollowed floor has to be optimized with regard to corrosion, for example by the use of a plastic frame between the hollowed floor made of a ferritic steel, on the one hand, and the metal shroud and the metal rear wall, on the other hand.

The metal shroud 8 which is formed from the right-hand metal side wall 3, the metal ceiling 4 and the left-hand metal side wall 5, thus forms the shape of a so-called "vertical U-shape".

Moreover, the metal shroud 8 on the front side is provided with a U-shaped frame part 9 which is downwardly open and forms a front surface F of the dishwashing compartment 2. The frame part 9 is positively connected by means of riveting, in particular thermal riveting, to the metal shroud 8 (see also FIG. 6 and FIG. 9) and engages in the hollowed metal floor 6 (see also FIG. 8). Moreover, the frame part 9 on the front side is provided with a peripheral groove-shaped contour 10 (see FIG. 9) which receives a door seal, known to the person skilled in the art, and the frame part preferably comprises a plastic, in particular a glass-reinforced polypropylene.

Figure 2:
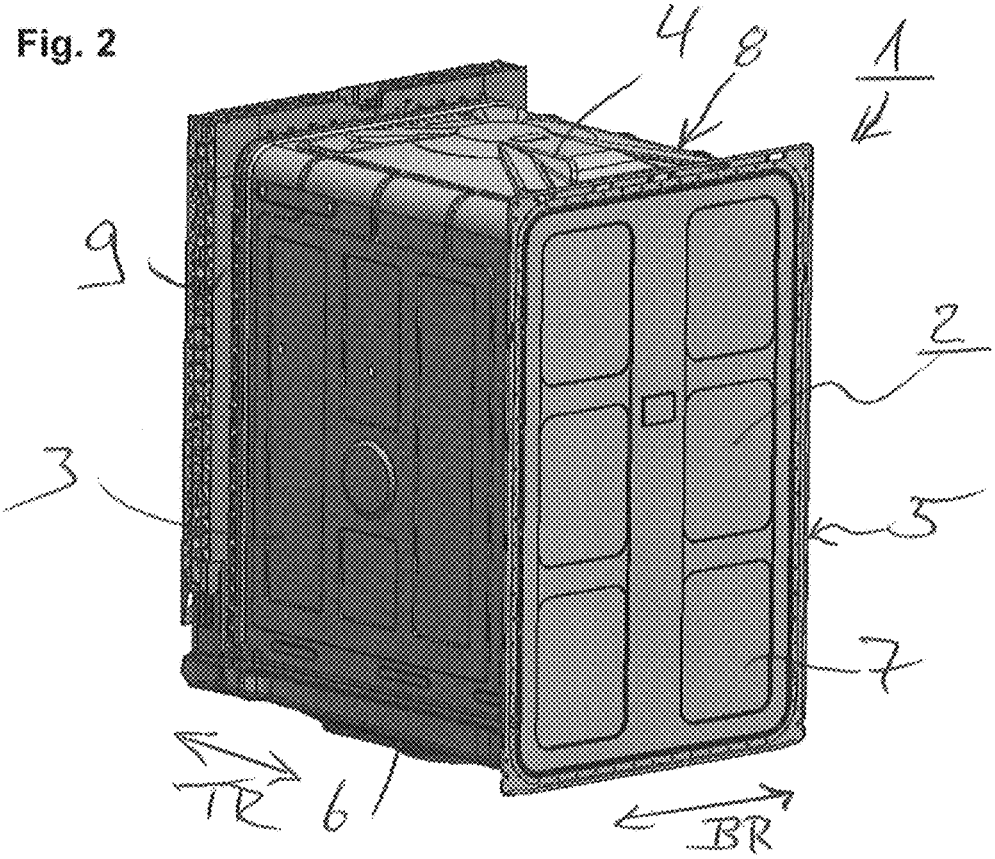
FIG. 2 shows a schematic perspective view of the preferred embodiment of the dishwashing compartment of the dishwasher according to the invention of FIG. 1 obliquely from the rear.

FIG. 2 shows a schematic perspective view of the dishwashing compartment 2 of the dishwasher 1 of FIG. 1 obliquely from the rear.

In this case, the substantially metal wall parts of the dishwashing compartment 2, i.e. the two metal side walls 3, 5, the metal ceiling 4, the hollowed metal floor 6 and the metal rear wall 7 are clearly visible. Also clearly identifiable are the shape of the metal shroud 8, a "vertical U-shape" and the frame part 9.

Figure 3:
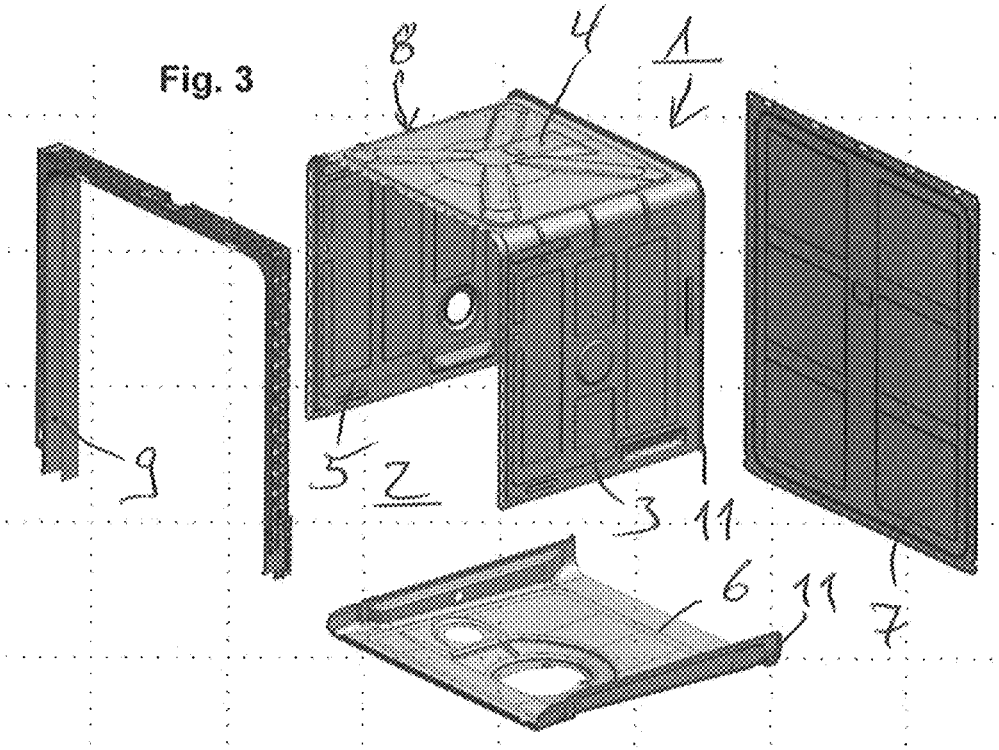
FIG. 3 shows a schematic exploded view of the preferred embodiment of the dishwashing compartment of the dishwasher according to the invention of FIG. 1.

FIG. 3 shows a schematic exploded view of the dishwashing compartment 2 of the dishwasher 1 of FIG. 1.

The substantially metal wall parts of the dishwashing compartment 2 are the metal shroud 8, the hollowed metal floor 6, the metal rear wall 7 and the frame part 9, wherein the metal shroud 8 is formed from the two metal side walls 3, 5 and the metal ceiling 4 and forms the shape of a "vertical U-shape". The metal shroud 8 and the hollowed metal floor 6 have in their rear regions an outward 90° bend 11.

Figure 4A:
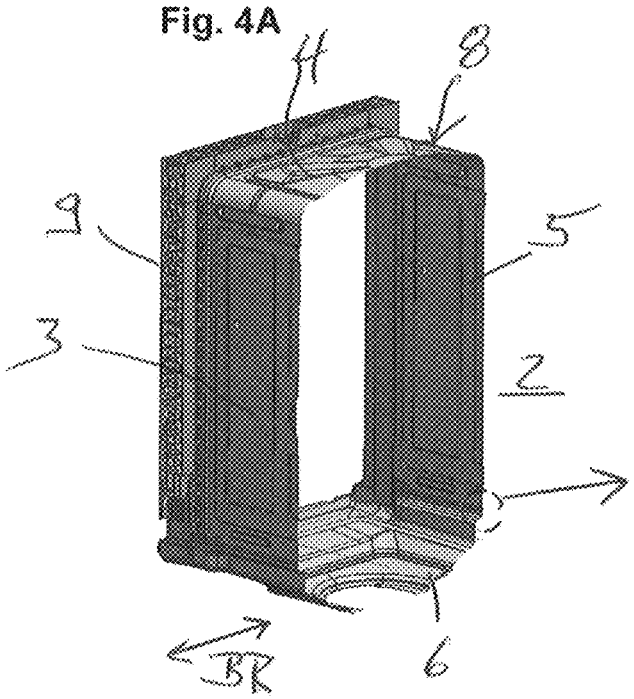
FIG. 4A shows a perspective sectional view in the width direction of the preferred embodiment of the dishwashing compartment of the dishwasher according to the invention of FIG. 2.

FIG. 4A shows a perspective sectional view in the width direction BR (double arrow) of the dishwashing compartment 2 of the dishwasher 1 of FIG. 2.

The metal shroud 8 of the dishwashing compartment 2 is formed from the two metal side walls 3, 5 and the metal ceiling 4 and forms the shape of a "vertical U-shape". The hollowed metal floor 6 is arranged on the lower side of the metal shroud 8, and the frame part 9 is arranged on the front side of the metal shroud 8.

Figure 4B:
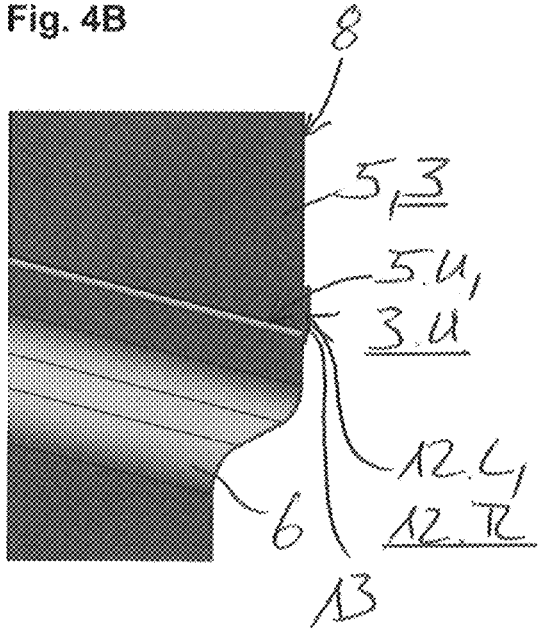
FIG. 4B shows a detailed view of the perspective sectional view in the width direction of the dishwashing compartment of the preferred embodiment of the dishwasher according to the invention of FIG. 4A.

FIG. 4B shows a detailed view of the perspective sectional view in the width direction BR (double arrow) of the dishwashing compartment 21 of the dishwasher 1 of FIG. 4A.

The two side walls 3, 5 of the metal shroud 8 on their respective lower wall edge 3.U, 5.0 are connected together in a form-fitting manner to the hollowed metal floor 6 by means of external interfaces 12.R, 12.L. The respective external interface 12.R, 12.L comprises a form-fitting connection 13, in particular a dynamic or static fold, or a roller seam weld. In the exemplary embodiment shown, the form-fitting connection 13 comprises a fold. Folding is a technique in sheet metal processing in which a sheet metal edge is bent back in order to produce a stiffening of the edge. However, roller seam welding is a method of resistance welding and directly derived from spot welding. Both production methods are suitable for the fluid-tight connection of the metal shroud 8 of the dishwashing compartment 2 to the hollowed metal floor 6 of the dishwashing compartment.

Figure 5A:
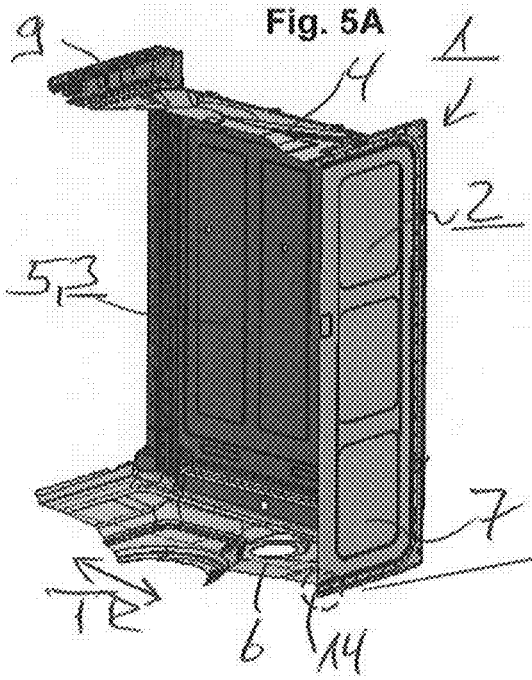
FIG. 5A shows a perspective sectional view in the depth direction of the preferred embodiment of the dishwashing compartment of the dishwasher according to the invention of FIG. 1.

FIG. 5A shows a perspective sectional view in the depth direction TR (double arrow) of the dishwashing compartment 2 of the dishwasher 1 of FIG. 1.

The metal shroud 8 of the dishwashing compartment 2 is formed from the two metal side walls 3, 5 and the metal ceiling 4 and forms the shape of a "vertical U-shape". The metal hollowed floor 6 is arranged on the lower side of the metal shroud 8 and the frame part 9 is arranged on the front side of the metal shroud 8. The metal rear wall 7, which is fitted on the rear side to the metal shroud 8 and to the metal hollowed floor 6, is attached by means of at least one sealing means in a substantially fluid-tight manner in the region of the edge regions 14 in contact with one another, in particular adhesively bonded thereon and/or preferably spot-welded.

Figure 5B:
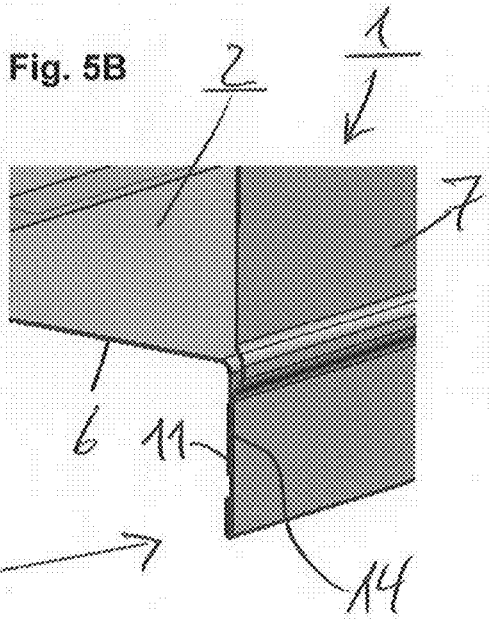
FIG. 5B shows a detailed view of the perspective sectional view in the depth direction of the preferred embodiment of the dishwashing compartment of the dishwasher according to the invention of FIG. 5A.

FIG. 5B shows a detailed view of the perspective sectional view in the depth direction TR (double arrow) of the dishwashing compartment 2 of the dishwasher 1 of FIG. 5A.

The metal hollowed floor 6 has in its region on the rear side an outward 90° bend 11. The metal rear wall 7 fitted on the rear side to the shroud, not shown, and to the metal hollowed floor 6 is attached in the region of the edge regions 14 in contact with one another, by means of at least one sealing means, in particular adhesively bonded thereon and/or preferably spot-welded. The sealing means comprises, for example, a silicone material or a contact adhesive.

Figure 6:
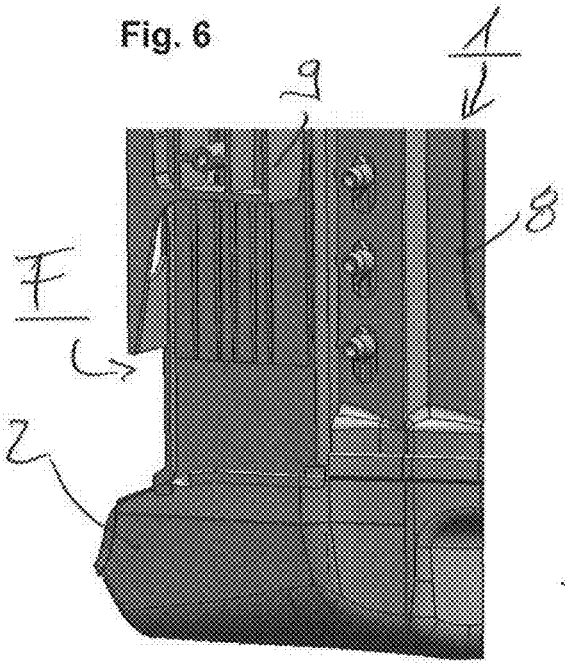
FIG. 6 shows a detailed view of the preferred embodiment of the dishwashing compartment of the dishwasher according to the invention of FIG. 2.

FIG. 6 shows a detailed view of the dishwashing compartment 2 of the dishwasher 1 of FIG. 2.

The U-shaped downwardly open frame part 9 forming a front surface F of the dishwashing compartment 2 is attached on the front side to the metal shroud 8 and, by means of riveting, in particular thermal riveting, connected in a form-fitting and fluid-tight manner to the metal shroud 8. The fluid-tight connection may be produced and ensured, for example, by means of the use of TPE or similar sealing means.

Figure 7:
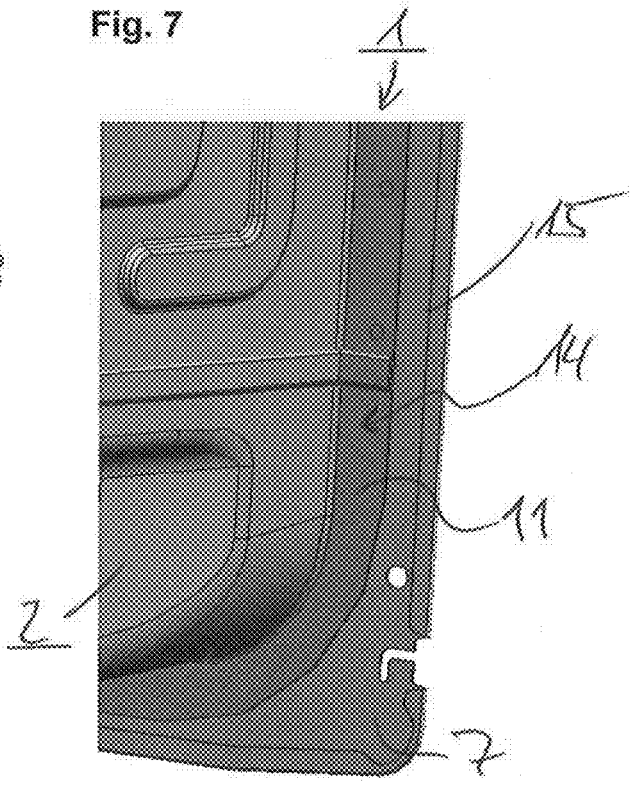
FIG. 7 shows a detailed view of the preferred embodiment of the dishwashing compartment of the dishwasher according to the invention of FIG. 1.

FIG. 7 shows a detailed view of the dishwashing compartment 2 of the dishwasher 1 of FIG. 1.

The metal shroud 8 and the metal hollowed floor 6 have in their regions on the rear side an outward 90° bend 11. The metal rear wall 7 is attached to this respective 90° bend 11 by means of at least one sealing means in a substantially fluid-tight manner in the region of the edge regions 14 in contact with one another, wherein the metal rear wall 7 has a preferably peripheral projection 15.

Figure 8:
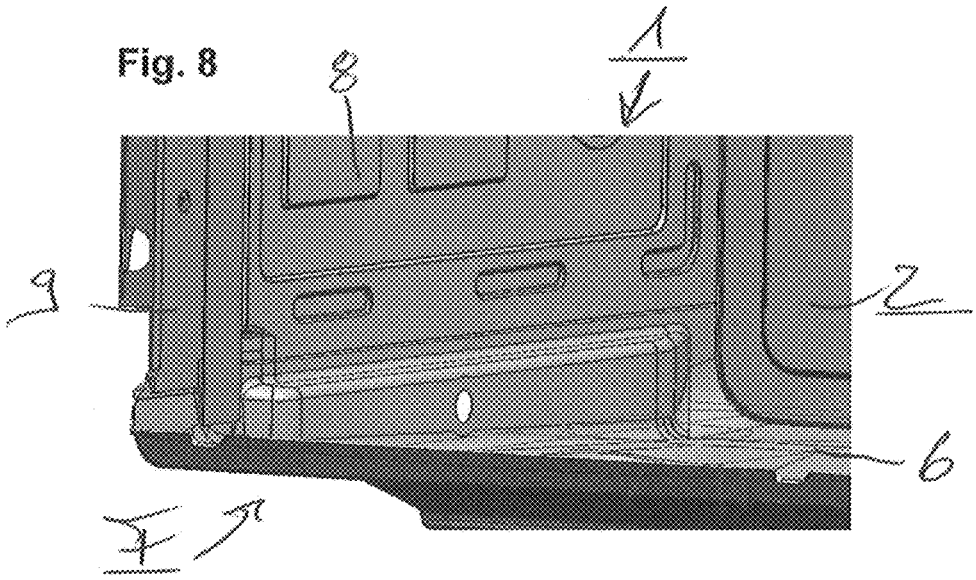
FIG. 8 shows a detailed view of the preferred embodiment of the dishwashing compartment of the dishwasher according to the invention of FIG. 2.

FIG. 8 shows a detailed view of the dishwashing compartment 2 of the dishwasher 1 of FIG. 2.

The metal shroud 8 is provided on the front side with the U-shaped downwardly open frame part 9 which forms the front surface F of the dishwashing compartment 2 and which engages in the metal hollowed floor 6.

Figure 9:
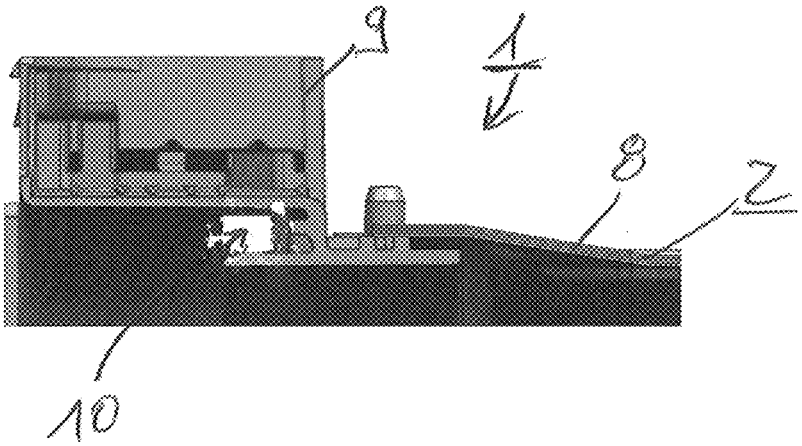
FIG. 9 shows a detail of a horizontal sectional view of the preferred embodiment of the dishwashing compartment of the dishwasher according to the invention of FIG. 1.

FIG. 9 shows a detail of a horizontal sectional view of the dishwashing compartment 2 of the dishwasher 1 of FIG. 1.

The U-shaped downwardly open frame part 9, forming the front surface F of the dishwashing compartment 2, is connected in a form-fitting and fluid-tight manner to the metal shroud 8 on the front side thereof. Moreover, the frame part 9, preferably comprising a plastic, in particular a glass fiber-reinforced polypropylene, is provided on the front side with a peripheral groove-shaped contour 10 which receives a door seal, not shown but known to the person skilled in the art.

Figure 10:
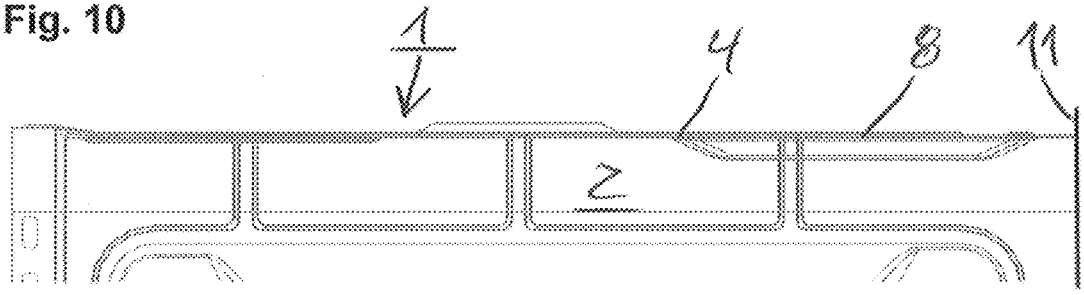
FIG. 10 shows a detail of a sectional view in the depth direction of the preferred embodiment of the dishwashing compartment of the dishwasher according to the invention of FIG. 1.

FIG. 10 shows a detail of a sectional view in the depth direction TR (double arrow) of the dishwashing compartment 2 of the dishwasher 1 of FIG. 1.

The metal shroud 8, i.e. the metal ceiling 4 shown, has an outward 90° bend 11 in its region on the rear side.

Figure 11:
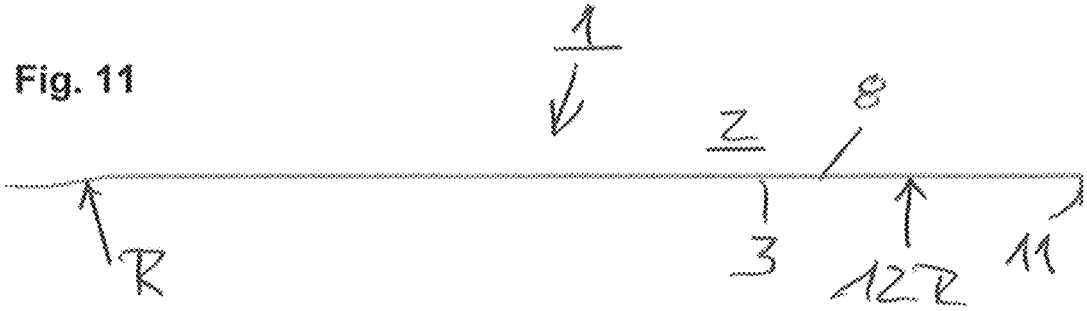
FIG. 11 shows a detail of a horizontal sectional view of the preferred embodiment of the dishwashing compartment of the dishwasher according to the invention of FIG. 1.
Figure 13:
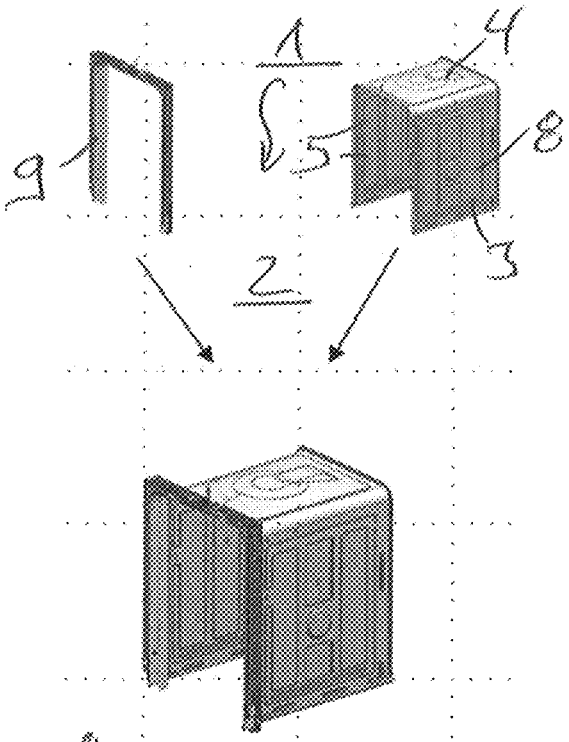
FIG. 13 to FIG. 16 show schematic perspective views of the successive production steps of the preferred embodiment of the dishwashing compartment of the dishwasher according to the invention of FIG. 1.
Figure 14:
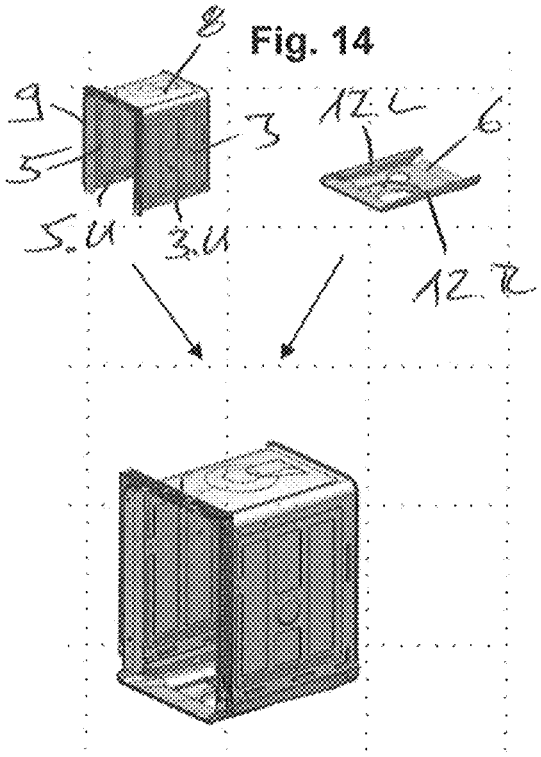
Figure 15:
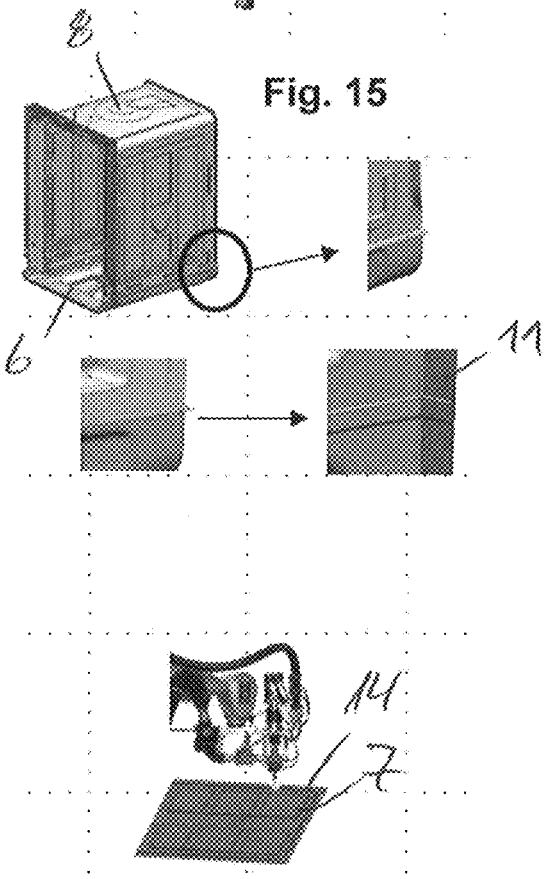
Figure 16:
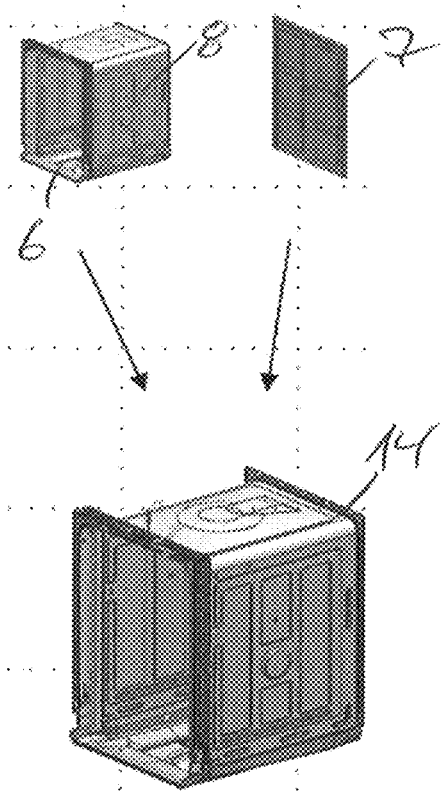
Figure 17A:
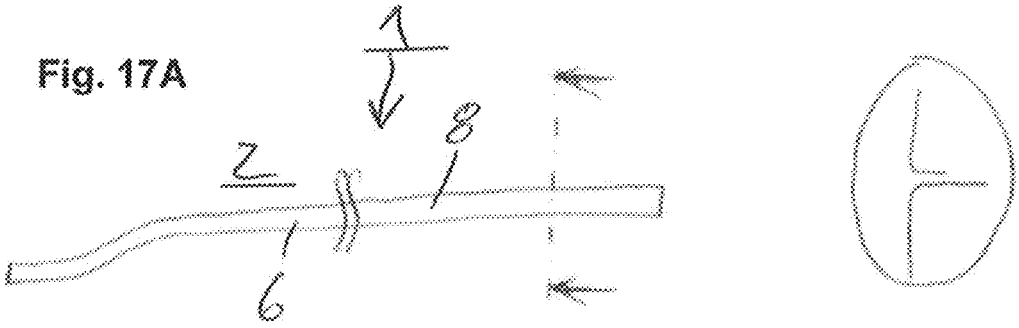
FIG. 17A to FIG. 17D show schematic perspective views of the successive production steps of the connection of the shroud-floor-rear wall of the preferred embodiment of the dishwashing compartment of the dishwasher according to the invention of FIG. 1.
Figure 17B:
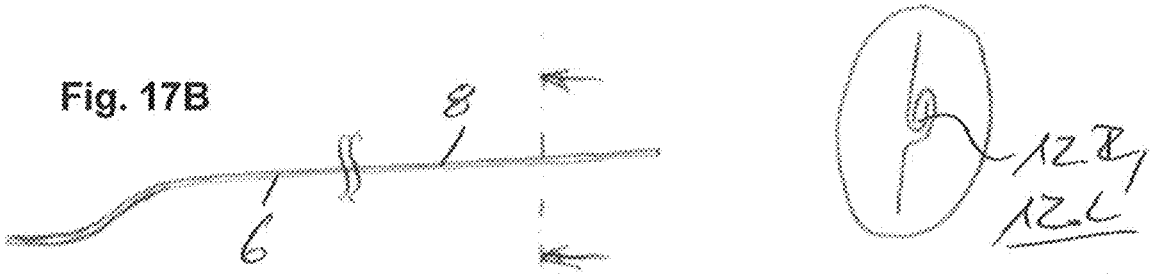
Figure 17C:
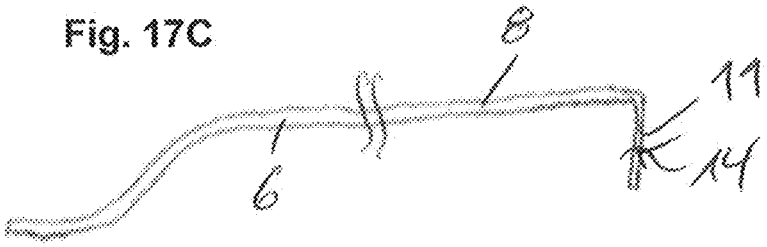
Figure 17D:
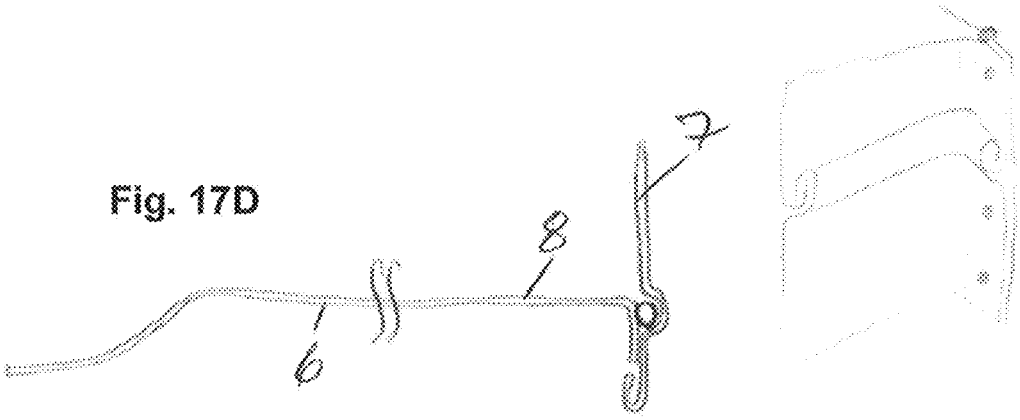

FIG. 11 shows a detail of a horizontal sectional view of the dishwashing compartment 2 of the dishwasher 1 of FIG. 1.

The metal shroud 8, i.e. the right-hand metal side wall 3 shown and the right-hand interface 12.R on the right-hand metal side wall 3, have an outward 90° bend 11 in their regions on the rear side. In their regions on the front side they have at least in sections a radius R of at least 80 mm outwardly, preferably of at least 100 mm outwardly, in particular of at least 80 mm outwardly. This radius R is also denoted in specialized circles as a fold angle.

FIG. 12A shows a further schematic perspective view of the dishwashing compartment 2 of the dishwasher 1 of FIG. 1.

The metal wall parts which ultimately form the periphery of the dishwashing compartment 2, i.e. the two metal side walls 3, 5, the metal ceiling 4 and the hollowed metal floor 6, i.e. also the interfaces 12.R, 12.L, before their respective 90° bend 11 in the connected-together state, have a linear or approximately linear path 16 in their regions on the rear side.

FIG. 12B shows a detailed view of the dishwashing compartment 2 of the dishwasher 1 of FIG. 12A.

The linear or approximately linear path 16 extends in the interfaces 12.R, 12.L on the rear side before the rear 90° bend 11 of the metal shroud 8 and the metal hollowed floor 6 connected thereto.

FIG. 13 to FIG. 16 show schematic perspective views of the successive production steps of the dishwashing compartment 2 of the dishwasher 1 of FIG. 1.

In a first production step (FIG. 13) the frame part 9 is connected in a form-fitting and fluid-tight manner to the metal shroud 8 forming the shape of a "vertical U-shape". The metal shroud 8 is formed from the two metal side walls 3, 5 and the metal ceiling 4, and which in the straightened-out state formed a preferably flat press part and was then bent in a U-shaped manner.

In a second production step (FIG. 14) the metal hollowed floor 6 is connected in a form-fitting manner to the metal shroud 8 together with the frame part 9. The hollowed metal floor is a deep-drawn part produced from a preferably austenitic steel. The form-fitting connection takes place on the respective lower wall edge 3.U, 5.0 of the metal side walls 3, 5 of the metal shroud 8 to the hollowed metal floor 6 by means of external interfaces 12.R, 12.L. The connection itself comprises a form-fitting connection, in particular a dynamic or static fold or roller seam weld.

In a further production step (FIG. 15), on the one hand, the sub-assembly formed from the metal shroud 8, the frame part 9 and the hollowed metal floor 6 in their region on the rear side are provided with a 90° bend 11. On the other hand, there is provision on the metal rear wall 7 in required regions 14 by means of a sealing means, for example a silicone material or a contact adhesive.

Additionally, in a fourth production step (FIG. 16) on the rear side the metal rear wall 7 is attached to the metal shroud 8 and to the hollowed metal floor 6, by means of at least one sealing means in a substantially fluid-tight manner in the region of the edge regions 14 in contact with one another, in particular adhesively bonded thereon and/or preferably spot-welded.

Naturally, the production of the dishwashing compartment 2 of the dishwasher 1 may also comprise further production steps, not specifically shown but known to the person skilled in the art.

FIG. 17A to FIG. 17D show schematic perspective views of the successive production steps of the connections of the metal shroud-floor-rear wall of the dishwashing compartment 2 of the dishwasher 1 of FIG. 1.

In a first production step (FIG. 17A) of the connection of the metal shroud-floor-rear wall of the dishwashing compartment 2 of the dishwasher 1, the components comprising the metal shroud 8 and the metal floor 6 are produced in at least one respective tool. Finally, the respective geometry of the connection to one another is produced.

In a second production step (FIG. 17B) of the connection of the metal shroud-floor-rear wall of the dishwashing compartment 2 of the dishwasher 1 the components comprising the metal shroud 8 and the metal floor 6 are connected together in a form-fitting and fluid-tight manner at interfaces 12.R, 12.L, preferably by means of folding.

In a further production step (FIG. 17C) of the connection of the metal shroud-floor-rear wall of the dishwashing compartment 2 of the dishwasher 1 the components comprising the metal shroud 8 and the metal floor 6, which are connected by means of interfaces 12.R, 12.L in their regions on the rear side, are subjected to a 90° bend 11 so that a peripheral edge region 14 is produced.

In a fourth production step (FIG. 17D) of the connection of the metal shroud-floor-rear wall of the dishwashing compartment 2 of the dishwasher 1, the metal rear wall 7 is fitted on the rear side to the metal shroud 8 and to the hollowed metal floor 6 and connected in a water-tight manner. The metal rear wall 7 is designed as a preferably flat press part.

Naturally, the production of the connection of the shroud-floor-rear wall of the dishwashing compartment 2 of the dishwasher 1 may also comprise further production steps, not specifically shown but known to the person skilled in the art.

Figure 18:
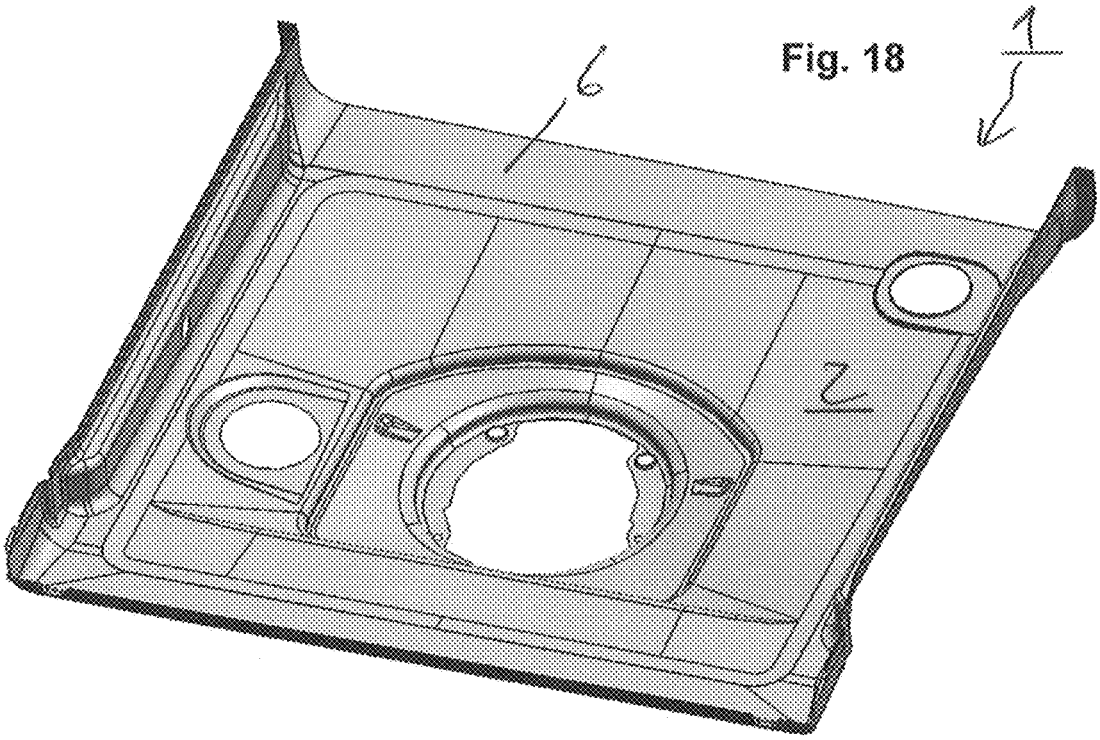
FIG. 18 shows a schematic perspective view of the hollowed metal floor of the preferred embodiment of the dishwashing compartment of the dishwasher according to the invention of FIG. 1.

FIG. 18 shows a schematic perspective view of the hollowed metal floor 6 of the dishwashing compartment 2 of the dishwasher 1 of FIG. 1.

The hollowed metal floor 6 has the described contour and any attachment regions for components of a dishwasher 1 which are known but not shown, such as for example the pump well, the salt container or the zeolite drying system.

Figure 19:
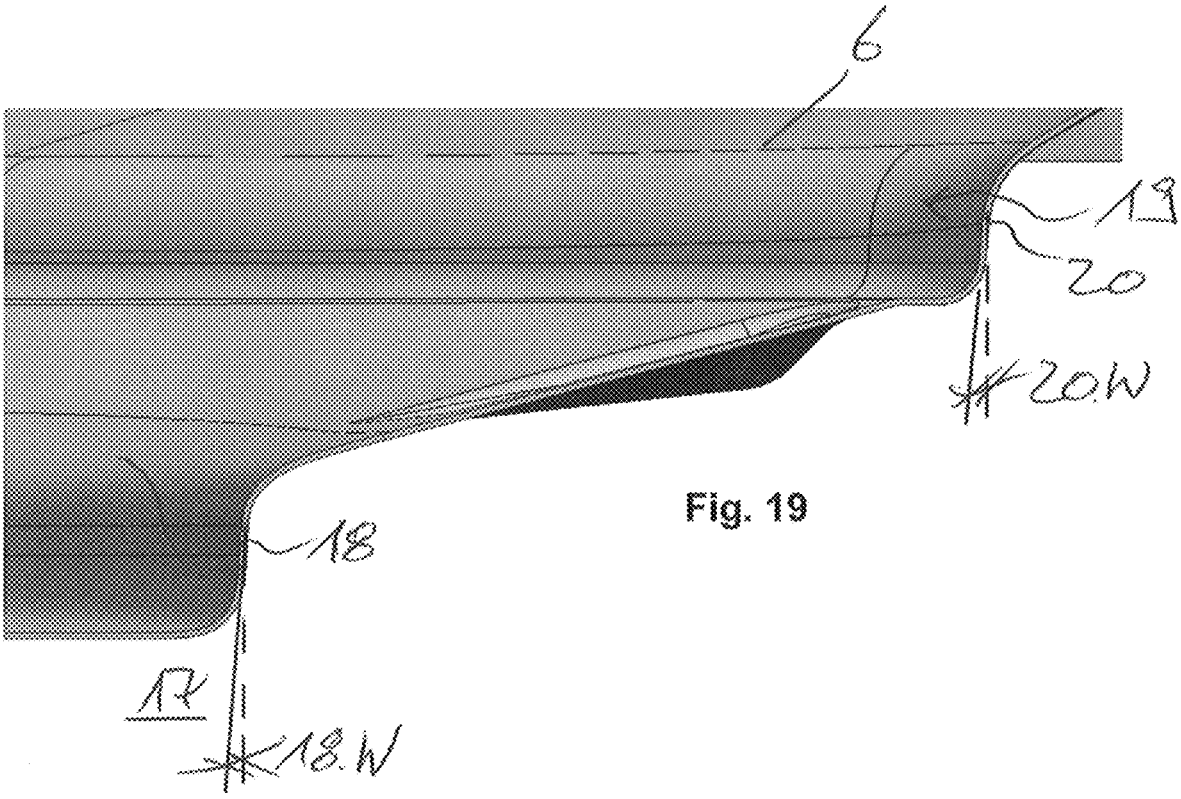
FIG. 19 shows a detail of a sectional view of the hollowed metal floor of the preferred embodiment of the dishwashing compartment of the dishwasher according to the invention of FIG. 18.

FIG. 19 shows a detail of a sectional view of the hollowed metal floor 6 of the dishwashing compartment 2 of the dishwasher 1 of FIG. 18.

The hollowed metal floor 6 preferably carries indirectly and on the lower side a pump well 17, not specifically shown, by means of at least one sealing means, such as for example a known pump well seal, in a substantially fluid-tight manner on an annular collar 18 formed in the hollowed metal floor 6. The annular collar 18 has a ring angle 18.W of 1 to 10° preferably of 2 to 5°, in particular of approximately 3°.

Moreover, the pump well 17 on the upper side is covered by a filter 19, not specifically shown. This filter 18 is at least positionable in a filter collar 20 formed in the hollowed metal floor 6 and having a filter angle 20.W of 2 to 10°, preferably of 4 to 8°, in particular of approximately 5°.

Figure 20A:
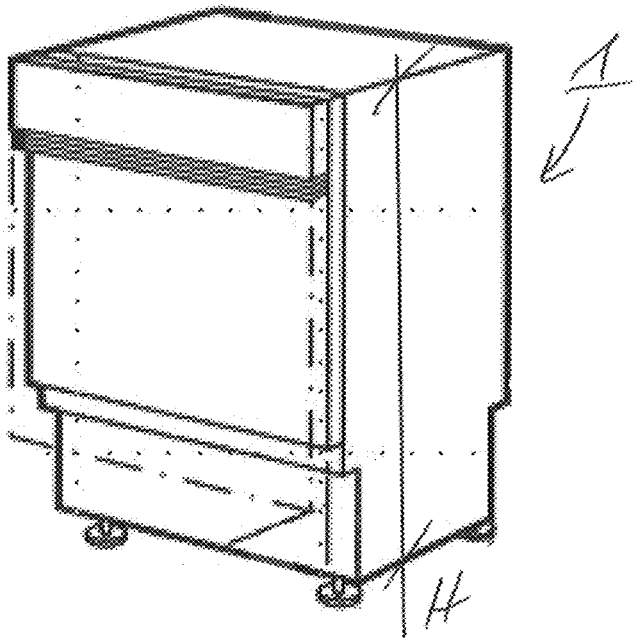
FIG. 20A to FIG. 20C show schematic views of different embodiments of dishwashers according to the invention.
Figure 20B:
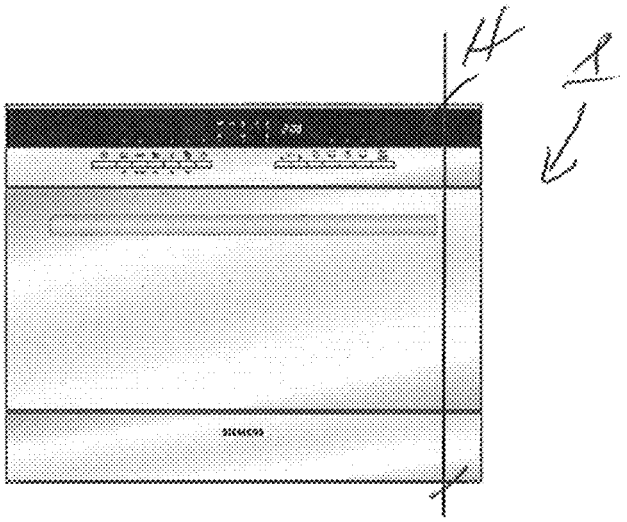
Figure 20C:
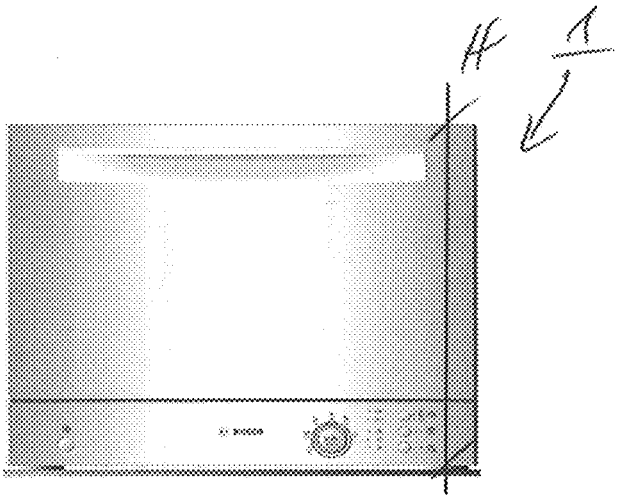

FIG. 20A to FIG. 20C show schematic views of different embodiments of dishwashers 1.

The dishwashers 1 shown represent different appliance types. The dishwasher 1 shown in FIG. 20A is a large appliance (freestanding, or able to be undermounted or fully integrated) with an appliance height H in the region of approximately 86.5 cm, approximately 81.5 cm, or approximately 77.5 cm. However, the dishwasher 1 shown in FIG. 20B is a high-level dishwasher with an appliance height H of 45.4 cm or 59.5 cm. In addition, the dishwasher shown in FIG. 20C with an appliance height H of 45 cm may be used as table-top dishwasher.

While the invention has been described with reference to exemplary embodiments, it is able to be modified in many different ways.

The invention claimed is:

1. A dishwasher having a dishwashing compartment which comprises a plurality of wall parts including a right-hand side wall, a ceiling, a left-hand side wall, and a metal rear wall and, in order to be loaded with items to be washed, is provided on a front side with a loading opening which is closed, at least temporarily, by a compartment door, wherein the right-hand side wall, the ceiling, and the left-hand side wall form a metal shroud which in the straightened-out state forms a flat press part which is then bent in a U-shaped manner to form a vertical, downward facing, U-shaped metal shroud, wherein a hollowed metal floor is a deep-drawn part produced from an austenitic steel, wherein the metal rear wall, which is fitted to a rear side of the U-shaped metal shroud and to a rear side of the hollowed metal floor, is configured in the form of a flat press part, wherein the right-hand side wall and the left-hand side wall of the U-shaped metal shroud are connected along their respectively lower wall edge to the hollowed metal floor, wherein the right-hand side wall and the left-hand side wall of the U-shaped metal shroud are each connected along their respectively lower wall edge, in a form-fitting manner, to the hollowed metal floor by a corresponding external interface, wherein each of the external interfaces comprises a form-fitting connection comprising a dynamic or static fold, and wherein on the rear side of the U-shaped metal shroud and on the rear side of the hollowed metal floor, each of the external interfaces is outwardly bent at 90°, so that a peripheral, rear-facing, frame-shaped edge region is produced, to which the metal rear wall is fitted.

2. The dishwasher of claim 1, constructed in the form of a domestic dishwasher.

3. The dishwasher of claim 1, wherein the external interfaces in their regions on the front side at least in sections have a radius of at least 80 mm outwardly.

4. The dishwasher of claim 1, wherein the external interfaces in their regions on the rear side have a linear or an approximately linear path.

5. The dishwasher of claim 1, further comprising a seal configured to attach the metal rear wall to the U-shaped metal shroud and to the hollowed metal floor in a substantially fluid-tight manner in a region of edge regions in contact with one another.

6. The dishwasher as claimed in claim 5, wherein the seal comprises a silicone material or a contact adhesive.

7. The dishwasher of claim 1, wherein the metal rear wall is adhesively bonded and/or spot-welded to the U-shaped metal shroud and to the hollowed metal floor.

8. The dishwasher of claim 1, wherein the U-shaped metal shroud includes a U-shaped frame part having a groove-shaped contour for receiving a door seal.

9. The dishwasher of claim 8, wherein a portion of the U-shaped frame part extends into the inside of the U-shaped metal shroud and is connected to the U-shaped metal shroud by at least one of riveting or thermal riveting.

10. The dishwasher of claim 8, wherein the U-shaped frame part is formed of at least one plastic and is configured to form a front surface of an interior of the dishwashing compartment.

11. The dishwasher of claim 8, wherein the right-hand and left-hand side walls, the metal rear wall and the U-shaped frame part have heights selected such that the dishwasher has an appliance height of approximately 86.5 cm, approximately 81.5 cm, approximately 77.5 cm, approximately 60 cm, or approximately 45 cm.

12. The dishwasher of claim 1, wherein the U-shaped metal shroud comprises an austenitic steel according to WNr. 1.4301 or a ferritic steel according to WNr. 1.4016.

13. The dishwasher of claim 1, wherein the hollowed metal floor comprises an austenitic steel according to WNr. 1.4301.

14. The dishwasher of claim 1, wherein the hollowed metal floor includes a lower side formed with an annular collar for carrying, indirectly, a pump well in a substantially fluid tight manner, said annular collar having a ring angle of 1 to 10°, and further comprising a filter covering an upper side of the pump well and positionable in a filter collar which is configured in the hollowed metal floor, and which has a filter angle of 2 to 10°.

* * * * *